US010077874B2

(12) United States Patent
Coleiny et al.

(10) Patent No.: US 10,077,874 B2
(45) Date of Patent: Sep. 18, 2018

(54) LIGHT EMITTING DIODE (LED) LAMP WITH TOP-EMITTING LEDS MOUNTED ON A PLANAR PC BOARD

(71) Applicant: LEDVANCE LLC, Wilmington, MA (US)

(72) Inventors: Golshan Coleiny, Boston, MA (US); Shiyong Zhang, Boxborough, MA (US)

(73) Assignee: LEDVANCE LLC, Wilmington, MA (US)

( * ) Notice: Subject to any disclaimer, the term of this patent is extended or adjusted under 35 U.S.C. 154(b) by 84 days.

(21) Appl. No.: 15/168,706

(22) Filed: May 31, 2016

(65) Prior Publication Data

US 2017/0343164 A1 Nov. 30, 2017

(51) Int. Cl.

| | |
|---|---|
| ***F21V 21/00*** | (2006.01) |
| ***F21K 9/238*** | (2016.01) |
| ***F21V 29/77*** | (2015.01) |
| ***F21V 7/00*** | (2006.01) |
| ***F21V 19/00*** | (2006.01) |
| ***F21V 23/00*** | (2015.01) |

(Continued)

(52) U.S. Cl.

CPC ..... *F21K 9/238* (2016.08); *F21V 3/0625* (2018.02); *F21V 7/00* (2013.01); *F21V 19/006* (2013.01); *F21V 23/005* (2013.01); *F21V 29/77* (2015.01); *F21Y 2101/00* (2013.01)

(58) Field of Classification Search

CPC ..... F21V 3/0445; F21V 7/00; F21V 19/006; F21V 23/005; F21Y 2101/00

USPC ..... 362/235, 249.02, 249.06, 249.14, 311.02

See application file for complete search history.

(56) References Cited

U.S. PATENT DOCUMENTS 5,567,036 A 10/1996 Theobald et al.
5,806,965 A * 9/1998 Deese ..... B64F 1/20 362/237

(Continued)

FOREIGN PATENT DOCUMENTS

| | | |
|---|---|---|
| DE | 100 29 069 A1 | 1/2002 |
| EP | 1 060 340 B1 | 8/2010 |
| WO | 99/53234 A1 | 10/1999 |

OTHER PUBLICATIONS

CLL630 Series side emitting packaged LED sell sheet, marketed by Citizen Electronics Co., Ltd. located on website http://ce.citizen.co.jp/productsse/info.php?no=88 (1 page, color).

(Continued)

*Primary Examiner* — Paultep Savusdiphol

(57) ABSTRACT

LED lamp 10 includes a housing, a mounting base, a light engine (LE) 16, light-transmissive cover 20 circumscribing the LE, and reflector 18. The LE comprises a plurality of top-emitting LED packages (TE-LED packages) mounted on planar upper surface 32 of PC board 26, each configured to emit light having an angular distribution centered around a principal light-emitting direction (PLED) normal to an emission face 45. A first set 36 of TE-LEDs is mounted with its PLED perpendicular to PCB 26 and a second set 38 of TE-LEDs is mounted to the PCB with its PLED orthogonal to that of the first set 36 of TE-LEDs and parallel to upper surface 32. Reflector 18 disposed below LE 16 reflects light towards cover 20. A polar light distribution of light emitted from LED lamp 10 is omnidirectional and is Energy Star compliant.

20 Claims, 10 Drawing Sheets

(51) Int. Cl.
*F21V 3/06* (2018.01)
*F21Y 101/00* (2016.01)

(56) References Cited

U.S. PATENT DOCUMENTS 6,227,679 B1 5/2001 Zhang et al.
6,234,648 B1 * 5/2001 Borner ..... C09K 11/584 313/312
6,659,632 B2 * 12/2003 Chen ..... H05K 1/189 362/249.06
6,746,885 B2 6/2004 Cao
6,899,443 B2 5/2005 Rizkin et al.
7,011,430 B2 3/2006 Chen
7,160,012 B2 1/2007 Hilscher et al.
7,192,155 B2 3/2007 Morrow et al.
7,213,940 B1 * 5/2007 Van De Ven ..... H05B 33/0803 257/89
8,021,028 B2 9/2011 Riesebosch
8,042,969 B2 * 10/2011 Paik ..... F21V 5/007 362/241
8,226,266 B2 7/2012 Chiang
8,272,762 B2 * 9/2012 Maxik ..... F21K 9/90 362/249.02
8,287,147 B2 10/2012 Tian et al.
8,297,799 B2 10/2012 Chou
8,449,150 B2 5/2013 Allen et al.
8,449,154 B2 * 5/2013 Uemoto ..... F21V 23/009 257/98
8,506,103 B2 * 8/2013 Iimura ..... F21V 7/041 362/254
8,894,268 B2 * 11/2014 Igaki ..... F21V 29/004 362/249.02
9,068,701 B2 6/2015 Progl
9,303,857 B2 * 4/2016 Desilva ..... F21V 17/164
9,625,107 B2 * 4/2017 Guo ..... F21K 9/64
2004/0022057 A1 * 2/2004 Lee ..... G08G 1/095 362/238
2009/0175041 A1 * 7/2009 Yuen ..... F21V 25/02 362/294
2010/0283369 A1 * 11/2010 Chen ..... F21V 3/00 313/1
2011/0095686 A1 4/2011 Falicoff et al.
2011/0116260 A1 * 5/2011 Kretschmann ..... H05B 33/0857 362/231
2011/0128742 A9 * 6/2011 Yuen ..... F21V 25/02 362/294
2012/0032573 A1 2/2012 Lai
2012/0134161 A1 * 5/2012 Kawamura ..... F21V 3/02 362/363
2014/0119009 A1 * 5/2014 Chen ..... F21V 17/168 362/235
2014/0153236 A1 6/2014 Chen et al.
2014/0218931 A1 * 8/2014 Desilva ..... F21V 17/164 362/294

OTHER PUBLICATIONS

ANSI Fig. C78.20-206 size specification for A19 (A60) bulb, pub. 2003 by ANSI, Lighting Group (NEMA) in revision ANSI C78. 20-2003 (1 page).

Data Sheet for CITILED® Model CLL630-0101B2-30AM1A2 Series side-emission LED packages, incl. mounting drawing on p. 2 (13 pages).

"Energy Star® Program Requirements for Integral LED Lamps" incl. Appendix B: Diagram of Omnidirectional Lamp Zones, version "Amended: Mar. 22, 2010" pub.'d EPA (30 pages).

Energy Star Program Requirements for Lamps "Partner Commitments" (3pp) and Product Specification Eligibility Criteria Ver. 1.1 (Rev. Aug. 2014) incl. Appx. A-1 Intensity Distribution Diagram (25 pp) (Total of 28 pp.).

* cited by examiner

LIGHT EMITTING DIODE (LED) LAMP WITH TOP-EMITTING LEDS MOUNTED ON A PLANAR PC BOARD

FIELD

The present disclosure is directed lighting devices, and more particularly, to a light emitting diode (LED) lamp including a plurality of top-emitting LEDs mounted on a planar PC board having a generally uniform omnidirectional light distribution.

BACKGROUND

Solid-state lighting technology such as light emitting diodes (LEDs) continue to increase in efficiency and capabilities, and have become a viable alternative to traditional incandescent and fluorescent light bulbs in many general lighting applications. For example, LED-based bulbs generally provide longer operational lifespans than traditional light bulbs, high-energy efficiency, compactness, and reliability.

One design challenge facing increased adoption of LED-based devices is their directional lighting characteristics. For instance, LED bulbs/devices generally deliver directional light, also known as forward light cone. A significant challenge for LED lighting (particularly retrofit LED A-type lamps) is to achieve wide light distribution. Non-limiting examples of LED modules or lamps include U.S. Pat. No. 9,068,701 (Progl); U.S. Pat. No. 8,449,150 (Allen); U.S. Pat. No. 8,297,799 (Chou); U.S. Pat. No. 8,287,147 (Tian); U.S. Pat. No. 8,226,266 (Chiang); U.S. Pat. No. 8,021,028 (Riesebosch); U.S. Pat. No. 7,160,012 (Hilscher); U.S. Pat. No. 7,011,430 (Chen); U.S. Pat. No. 6,899,443 (Rizkin); U.S. Pat. No. 6,746,885 (Cao); U.S. Pat. No. 6,227,679 (Zhang); U.S. Pat. No. 5,806,965 (Deese); U.S. Pat. No. 5,567,036 (Theobald); US Pub. 2014/0218931 (Desilva); US Pub. 2014/0153236 (Chen); US Pub. 2012/0032573 (Lai); US Pub. 2011/0095686 (Falicoff); EP 1 060 340 (Scianna); German DE 100 29 069 (Stoyan); and PCT WO 99/53234 (Schlag).

Most of the known LED retrofit A-type lamps cannot emit light having a generally uniform, omnidirectional distribution. Unfortunately, some of the known LED lamps do not fit within a spatial envelope defined for the particular lamp that is to be replaced (e.g., but not limited to, an ANSI A19 spatial envelope as generally illustrated in FIG. 1), and therefore cannot be considered to be retrofit LED lamps. Moreover, some of the known LED A-type lamps include complicated optical and secondary optics such as side-emitting LED packages, wherein a side-emitting LED package of this prior art is understood as an emission face for emitting light coupled to an optic/cover that is disposed directly adjacent to (e.g., on top of) the emission face that redirects the light such that a significant amount of the light emitted from the side emitting LED package is emitted substantially parallel to the emission face of the LED. Examples of a side-emitting LED arrangements is described in U.S. Pat. No. 7,192,155 (Morrow). Unfortunately, some LED lamps that utilize side-emitting LED packages cannot achieve generally uniform omnidirectional light distribution and/or the necessary optics reduce the overall efficiency of the LED type lamp and increase the manufacturing costs making them commercially impractical.

Figure 1:
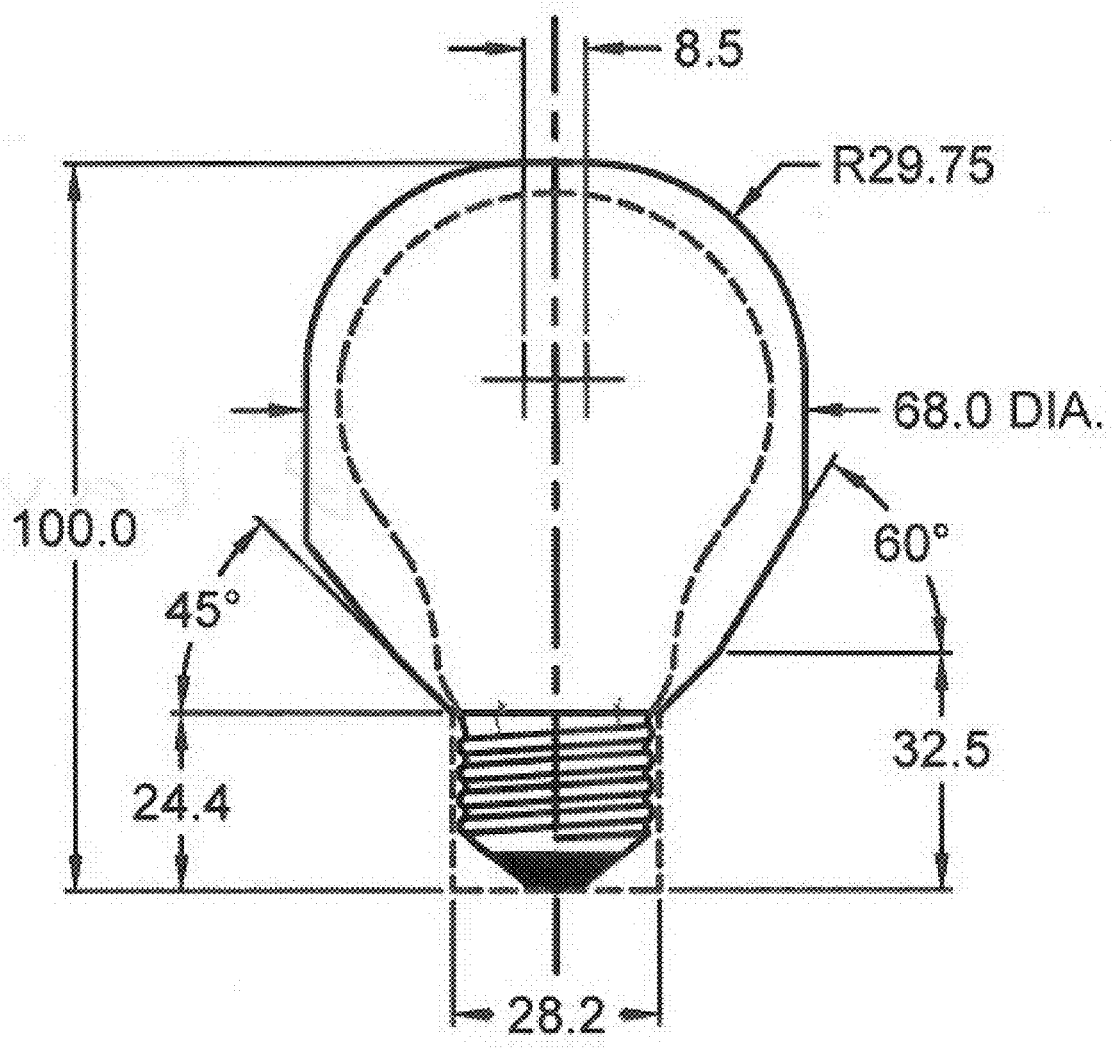
FIG. 1 PRIOR ART
FIG. 1 is a Prior Art schematic of the spatial volume envelope for an ANSI type A-19 (A60) incandescent lamp, given at ANSI C78.20-2003 (revision of ANSI C78.20-1995), in which dimensions are in millimeter (mm) unless otherwise specified.

These and other features of the present embodiments will be understood better by reading the following detailed description, taken together with the figures herein described. The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION

Figure 2:
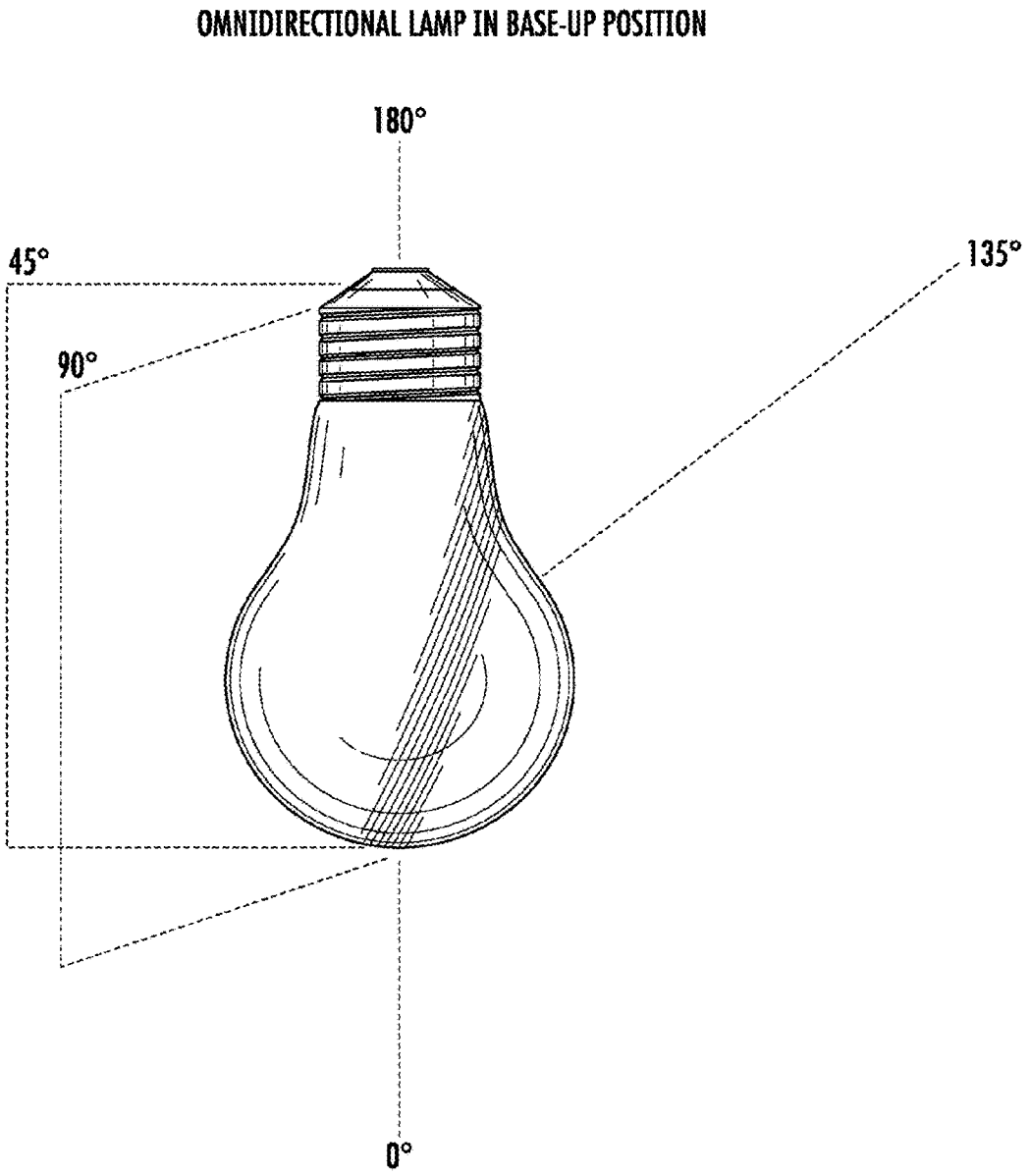
FIG. 2 PRIOR ART
FIG. 2 is a diagram from Appendix B "Diagram of omnidirectional lamp zones" (base-up position) of the ENERGY STAR™ "Program Requirements for Integral LED Lamps", (pub. EPA Dec. 3, 2009, amended Mar. 22, 2010).

As used herein, the terms "ENERGY STAR," "Energy Star standard," and "Energy Star compliant" refer to Energy Star "Program Requirements for Integral LED Lamps", Energy Star™ (pub'd. EPA, Dec. 3, 2009, amended Mar. 22, 2010), hereby incorporated by reference in its entirety. By way of a general overview, the Energy Star standard prescribes the luminous intensity distribution of an omnidirectional LED/lamp (also called non-directional lamp). With reference to FIG. 2, the Energy Star standard requires that lighting devices must include even distribution of luminous intensity (candelas (cd)) within the 0° to 135° zone (vertically axially symmetrical), thus over the zone +135 degrees to −135 degrees. Luminous intensity at any angle within this zone should not differ from the mean luminous intensity for the entire 0° to 135° zone by more than 20%. At least 5% of total flux (lumens) must be emitted in the 135° to 180° zone. Stated differently, in the zone within 270 degrees below the lighting device, the luminous intensity should be large and even, and in the zone within 90 degrees above the bulb, the luminous flux should not be too small.

In general, the present disclosure features an Energy Star compliant omnidirectional LED retrofit lamp that includes a housing, a mounting base, a light engine, a reflector, and a light-transmissive cover. As explained herein, the light engine features a plurality of top-emitting LED packages each configured to emit light having an angular distribution centered around a principal light-emitting direction that is normal to an emission face of the LED. The plurality of LED packages are coupled to and arranged about a planar surface of the light engine such that the light emitted from the light-transmissive cover is emitted in an omnidirectional light pattern having a uniformity consistent with the Energy Star standard. Additionally, the Energy Star compliant omnidirectional LED retrofit lamp consistent with the present disclosure fits within a standard spatial envelope for a lamp, e.g., an A-19 spatial envelope depicted in FIG. 1.

Figure 3:
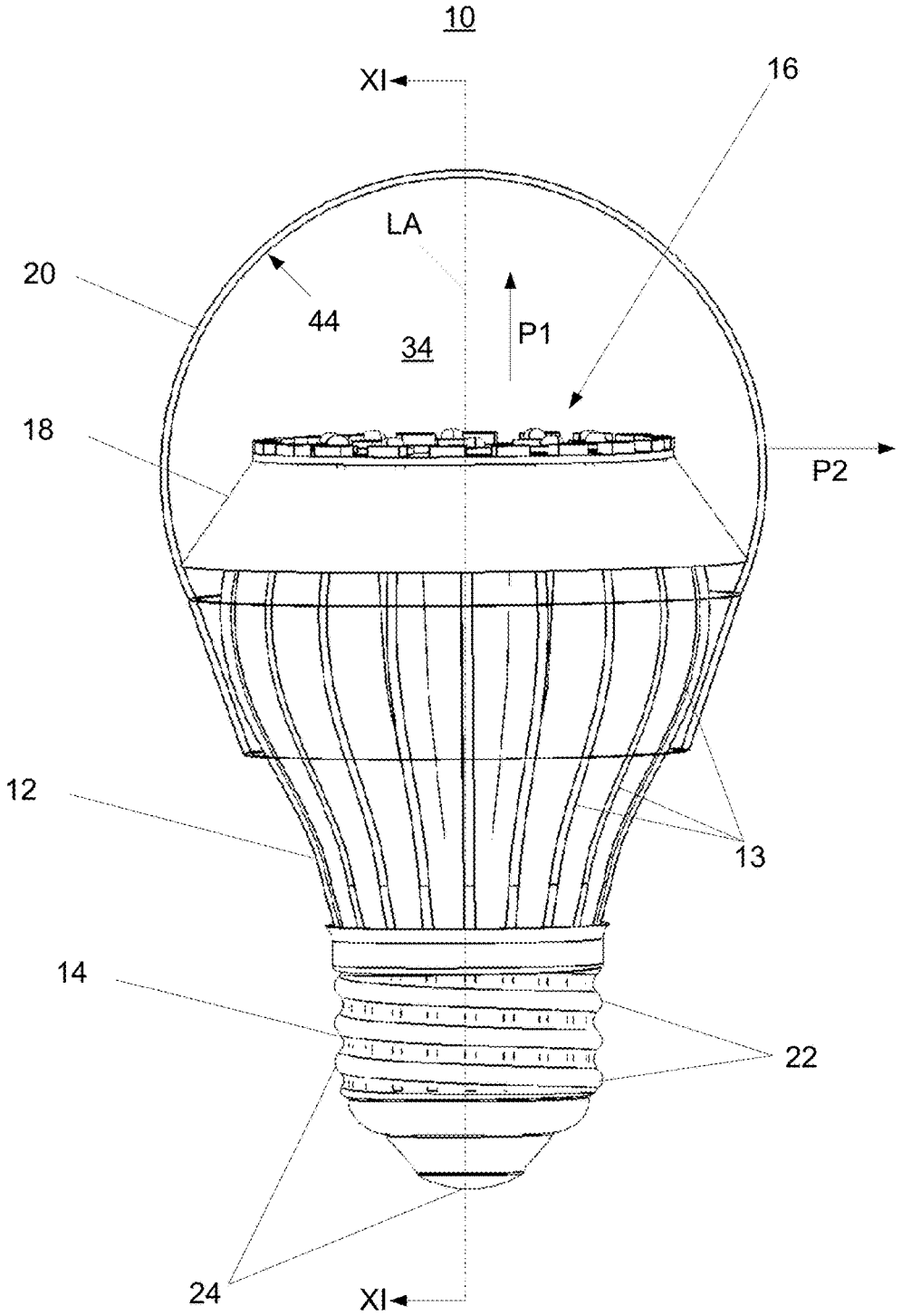
FIG. 3 illustrates a side view of an omnidirectional LED retrofit lamp, in accordance with an embodiment of the present disclosure.
Figure 4:
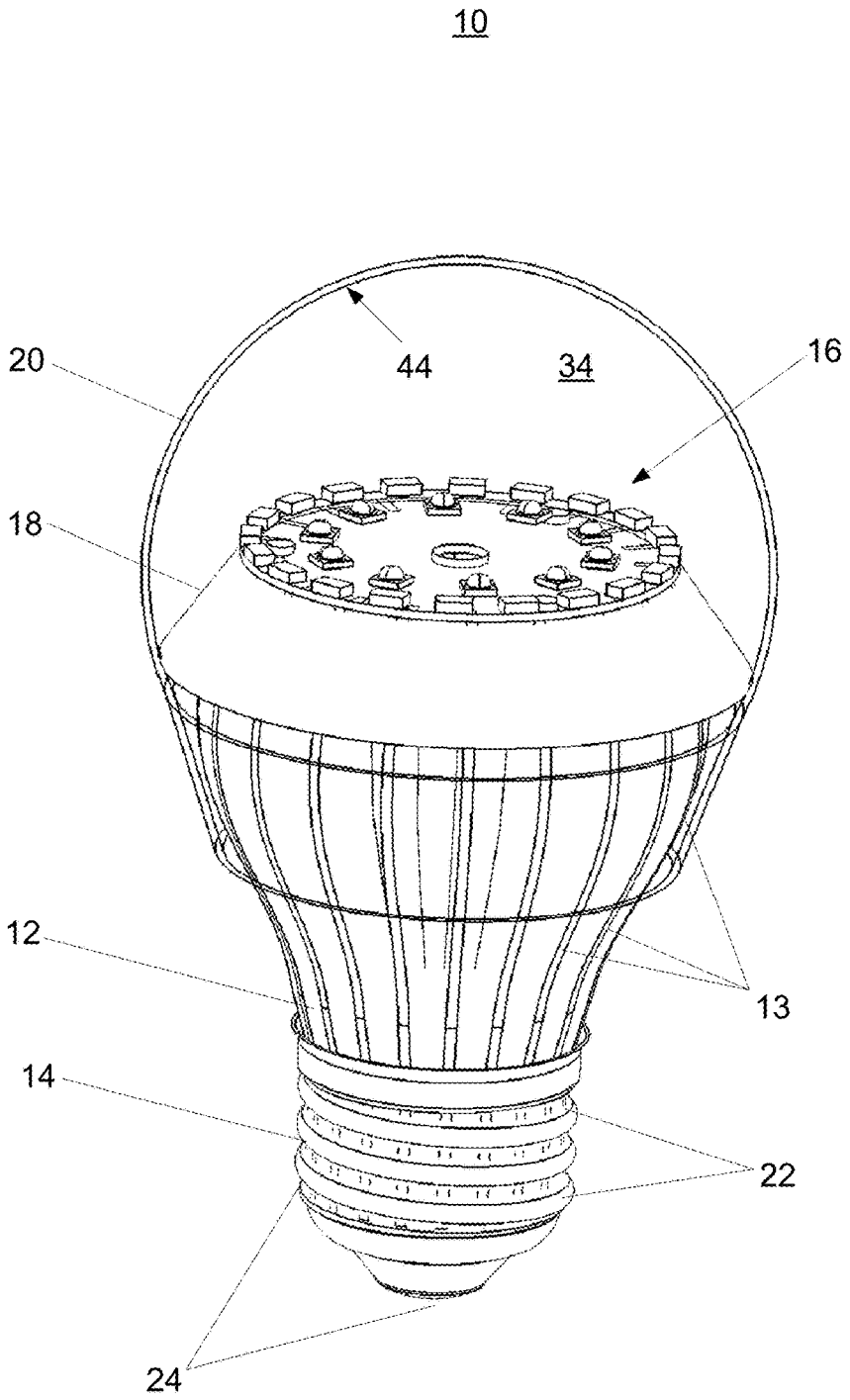
FIG. 4 illustrates a perspective view of the omnidirectional LED retrofit lamp of FIG. 3.

FIGS. 3 and 4 illustrate an embodiment of an Energy Star compliant omnidirectional light emitting diode (LED) retrofit lamp 10 consistent with the present disclosure. As noted above, the Energy Star compliant omnidirectional LED retrofit lamp 10 includes a housing 12, a mounting base 14, a light engine 16, reflector 18, and a light-transmissive cover 20.

The housing 12 functions as a support structure and/or heat management structure for the Energy Star compliant omnidirectional LED retrofit lamp 10. For example, the housing 12 includes a frame to which the light engine 16 and mounting base 14 are directly or indirectly coupled, mounted, and/or otherwise secured thereto. The housing 12 optionally includes a heat sink that dissipates heat generated by the light engine 16. For example, the housing 12 includes a plurality of fins 13 (e.g., either vertical and/or horizontal fins) that are made from a material having a high thermal conductivity (such as, but not limited to, copper or copper alloys, aluminum or aluminum alloys, ceramics, and/or the like). According to one embodiment, the reflector 18 and/or the light-transmissive cover 20 is coupled (either directly or indirectly) to the housing 12.

The mounting base 14 is directly or indirectly coupled, mounted, and/or otherwise secured to the housing 12 and is configured to make mechanical and electrical connection with a socket of an existing light fixture. For example, the mounting base (which is sometimes referred to as an Edison connector) is received within an existing light fixture through threaded engagement of the threads 22 on the mounting base 14 with corresponding threads on the existing lighting fixture (not shown). The mounting base 14 may include one or more electrical connections 24 configured to electrically couple the light engine 16 to the lighting fixture.

Figure 5:
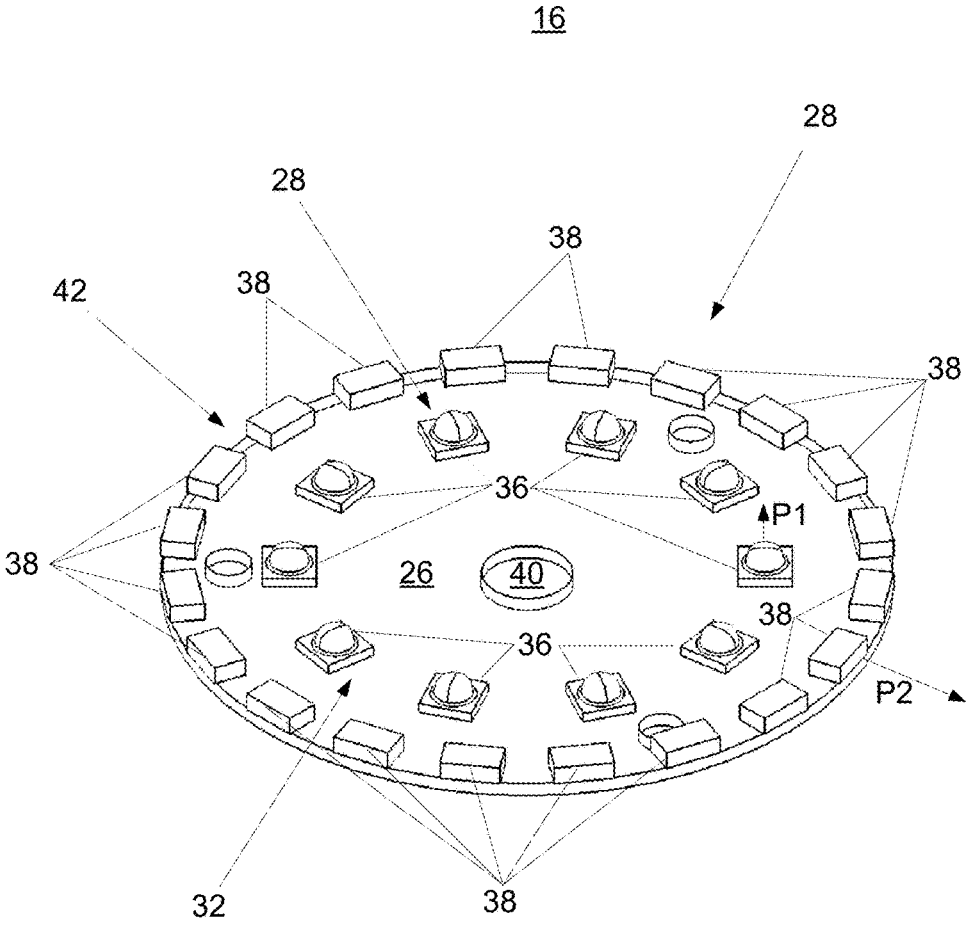
FIG. 5 illustrates a perspective view of the light engine of the omnidirectional LED retrofit lamp of FIG. 3.

The light engine 16 (FIGS. 5 and 6) includes a printed circuit board (PCB) 26, a plurality of top-emitting LED packages 28, and driver circuitry 30. The PCB 26 is directly or indirectly coupled, mounted, and/or otherwise secured to the housing 12, e.g., the heat sink). The PCB 26 is disposed within a cavity 34 defined by the light-transmissive cover 20 (and optionally also the reflector 18 and/or housing 12). The PCB 26 includes a generally planar upper surface 32. The planar upper surface 32 extends in a plane that is generally perpendicular to the major/longitudinal axis LA (see, e.g., FIG. 6) of the Energy Star compliant omnidirectional LED retrofit lamp 10. According to one embodiment, the longitudinal axis LA of the Energy Star compliant omnidirectional LED retrofit lamp 10 extends through a central region of the housing 12, mounting base 14, and the light-transmissive cover 20. The upper surface 32 of the PCB 26 is preferably tangent to a single plane, i.e. upper surface 32 is flat over its entirety.

Figure 7:
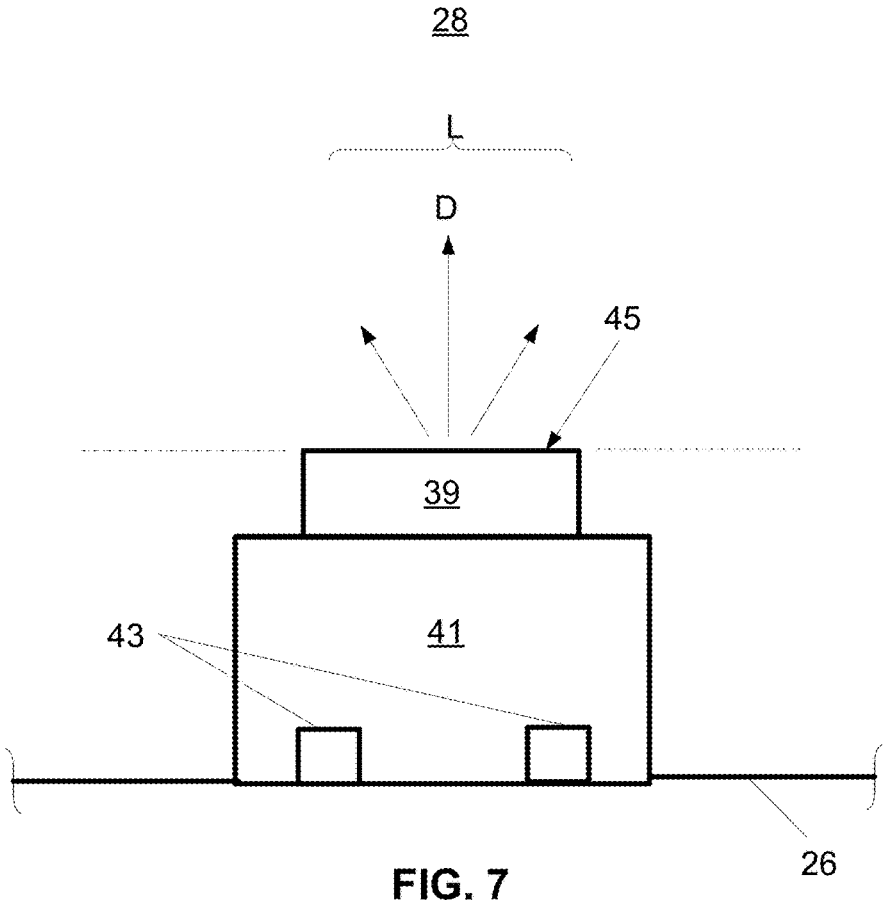
FIG. 7 illustrates one embodiment of a top-emitting LED package, in accordance with an embodiment of the present disclosure.

The plurality of top-emitting LED packages 28 may be directly or indirectly coupled, mounted, and/or otherwise secured to the upper surface 32 of the PCB 26. As seen in FIG. 7, each of the plurality of top-emitting LED packages 28 includes an (at least one) LED 39, a frame/mount 41 for supporting the LED 39, and two or more electrical contacts or electrodes 43 for providing electrical current to the LEDs. For example, the top-emitting LED package 28 may include a first pair of electrodes 43 extending outward from a lateral side of the frame, as is visible in FIG. 7, and a second pair of electrodes 43 (hidden in FIG. 7 by PCB 26) extending outward from a base of the frame such that the emission face/surface 45 of the LED may be disposed in either a first or a second direction relative to the planar upper surface 32 of the PCB 26.

As defined herein, a "top-emitting LED package" is configured to emit light L from the LED package 28 having an angular distribution centered around a principal light-emitting direction D that is normal to an emission face 45 of the LED 39. The term top-emitting LED package 28 therefore refers to the orientation of the principal light-emitting direction D of the light L emitted from the LED package 28 relative to the emission face 45 of the LED 39, regardless of the trade designation of "top-" or "side-" emitting under which any particular commercially available LED is marketed, and also does not refer to the orientation of the LED package 28 relative to the PCB 26.

Figure 8:
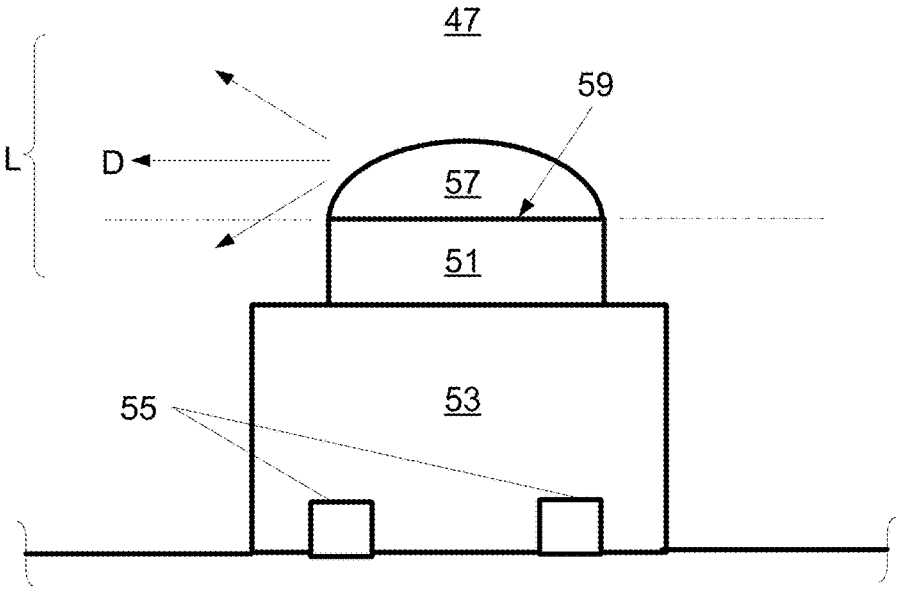
FIG. 8 PRIOR ART
FIG. 8 shows an example of a side-emitting LED package.

As is shown in the prior art FIG. 8, in contrast to top-emitting LED package 28, side-emitting LED package 47 (see FIG. 8) has one or more LEDs 51, frame 53, two or more electrical contacts/electrodes 55, and a batwing optic 57 coupled to emission face 59 of LEDs 51. The batwing optic 57, importantly for conventional side-emitting LED package 47, redirects light L from the emission face 59 of the LEDs 51 such that the principal light-emitting direction D of light L emitted from the side-emitting LED package 47 is substantially parallel to the emission face 59 of the LED 51, whereby light emitted in direction D is parallel to a PCB upper surface on which side-emitting LED package 47 is mounted. As such, whereas a side-emitting LED package 47 includes optics 57 that redirect the light L from emission face 59 of the LED 51, a top-emitting LED package 28 of the present disclosure is devoid of such a batwing optic 57. As a result, the principal light-emitting direction D of the light emitted by a top-emitting LED package 28 is perpendicular the emission face 45 of the LED 39 whereas the principal light-emitting direction D of light L emitted by a side-emitting LED package 47 is parallel to the emission face 59 of the LED 51.

Figure 9:
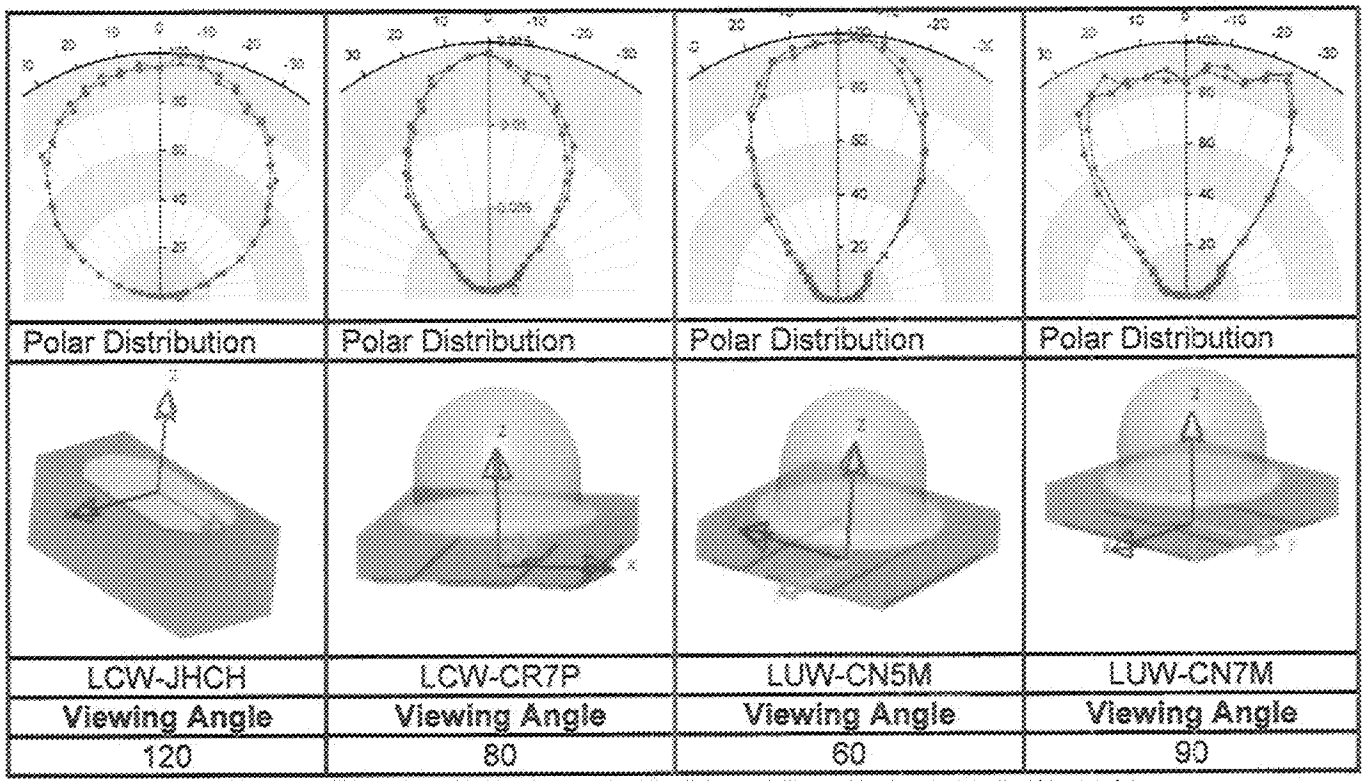
FIG. 9 shows various examples of top-emitting LED packages and with different viewing angles, in accordance with embodiments of the present disclosure.

Referring to FIG. 9, top-emitting LED packages 28 may have different angular distributions or viewing angles. For example FIG. 9 shows a comparison of four exemplary top-emitting LED packages 28 with different viewing angles is generally illustrated. As may be seen, the viewing angles of the top-emitting LED packages 28 may range from 120 degrees to 60 degrees. According to one embodiment, the viewing angles of the top-emitting LED packages 28 may be 120 degrees or less, for example, the viewing angles may be 90 degrees or less, 80 degrees or less, and/or 60 degrees or less.

Referring back to FIG. 5, the plurality of top-emitting LED packages 28 includes a first set 36 of top-emitting LED packages 28 mounted to the upper surface 32 of the PCB 26 and a second set 38 of top-emitting LED packages 28 mounted to the upper surface 32. The first set 36 of top-emitting LED packages 28 is mounted to the upper surface 32 of the PCB 26 such that the principal light emitting direction P1 of their top-emitting LED packages 28 is orientated perpendicular to the planar upper surface 32 of the PCB 26. Put another way, the first set 36 of top-emitting LED packages 28 is mounted to the upper surface 32 of the PCB 26 such that the emission face 45 of their LEDs is parallel to the upper surface 32 and the principal light emitting direction P1 of their top-emitting LED packages 28 is orientated generally upwards from the planar upper surface 32 of the PCB 26.

In contrast, the second set 38 of top-emitting LED packages 28 is mounted to the upper surface 32 of the PCB 26 such that the principal light emitting direction P2 of their top-emitting LED packages 28 is orientated parallel to the planar upper surface 32 of the PCB 26. Put another way, the second set 38 of top-emitting LED packages 28 is mounted to the upper surface 32 of the PCB 26 ninety (90) degrees (i.e., orthogonal) relative to the first set 36 of top-emitting LED packages 28 (and the upper surface 32) such that the emission face 45 of their LEDs is perpendicular to the upper surface 32 and the principal light emitting direction P2 of their top-emitting LED packages 28 is orientated generally parallel to the planar upper surface 32 of the PCB 26.

As described herein, the first and second sets 36, 38 of top-emitting LED packages 28 are arranged about the upper surface 32 of the PCB 26 such that the light emitted from the omnidirectional LED retrofit lamp 10 is compliant with the Energy Star standard. According to one embodiment, the first set 36 of top-emitting LED packages 28 are arranged in a central region 40 of the upper surface 32 of the PCB 26 and the second set 38 of top-emitting LED packages 28 are arranged about a perimeter and/or periphery 42 of the upper surface 32 of the PCB 26. For example, the second set 38 of top-emitting LED packages 28 is arranged in a generally circular or ring shape extending around the first set 36 of top-emitting LED packages 28. In one instance, the second set 38 of top-emitting LED packages 28 is positioned on the upper surface 32 within a region bounded by an imaginary circle having a 40 mm diameter. The first set 36 of top-emitting LED packages 28 comprises ten (10) top-emitting LED packages 28 and the second set 38 of top-emitting LED packages 28 comprises twenty (20) top-emitting LED packages 28. Alternatively, the first set 36 of top-emitting LED packages 28 may comprise not more than ten (10) top-emitting LED packages 28 and the second set 38 of top-emitting LED packages 28 may comprise not more than twenty-five (25) top-emitting LED packages 28 (e.g., not more than 20 top-emitting LED packages 28). In any of the embodiments, the first set 36 of top-emitting LED packages 28 may emit 25 lumens each and the second set 38 of top-emitting LED packages 28 may emit 50 lumens each. In some embodiments, the light emitted by the omnidirectional LED retrofit lamp 10 in a range of transmission from −135 degrees to +135 degrees has a minimum luminous flux of 1030 lumens integrated value.

Embodiments of the omnidirectional lamp 10 were simulated using technical specifications based on commercially available LEDs. Suitable top-emitting LED packages 28 for use in the first set 36, positioned to emit light perpendicular to PCB 26 (direction P1), are marketed by the company Osram Opto Semiconductors under the trade designation Duris E5 or Duris P5 which are known to each emit 38 and 32 lumens at operating current, respectively. Suitable top-emitting LED packages 28 for use in the second set 38, positioned to emit light parallel to PCB 26 (direction P2), are marketed by the company Citizen under the trade designation "CLL630 Side View LED" which are known to emit 32 lumens each at operating current and though offered in the trade as "side-emitting LEDs" and are understood to be a type of top-emitting LED package 28 for purposes of the present disclosure. Alternatively, another LED package 28 believed suitable for use in the second set 38, to effect light emission parallel to PCB 26, would be a modification of a commercially available Osram Opto Duris E5 platform, which, though in this form not commercially offered nonetheless a person of ordinary skill appreciates could be manufactured in a modified version using conventional technology by providing a frame mount to be manufactured with both side and bottom electrodes and to provide a light output of 50 lumens instead of 38 lumens as on the commercial Duris E5. An exemplary embodiment of lamp 10 has ten (10) Duris E5 LED packages arranged as first set 36 oriented to emit light in the top direction P1 and twenty (20) Citizen CLL630 LED packages arranged as second set 38 to emit light in side direction P2, and an approximate aggregate cost of these 30 LEDs is about US $3.10.

It should be appreciated, however, that the above described arrangements of the first and second sets 36, 38 of top-emitting LED packages 28 are illustrative only, and that other arrangements are possible (e.g., the first and second sets 36, 38 of top-emitting LED packages 28 could be at least partially alternatingly arranged around the perimeter and/or periphery 42 of the upper surface 32. Additionally, the number, placement, orientation, viewing angles, and lumens of the plurality of top-emitting LED packages 28, as well as the luminous flux integrated values of the Energy Star compliant omnidirectional LED retrofit lamp 10, may be adjusted based on the intended application and specific goals of the Energy Star compliant omnidirectional LED retrofit lamp 10.

Figure 6:
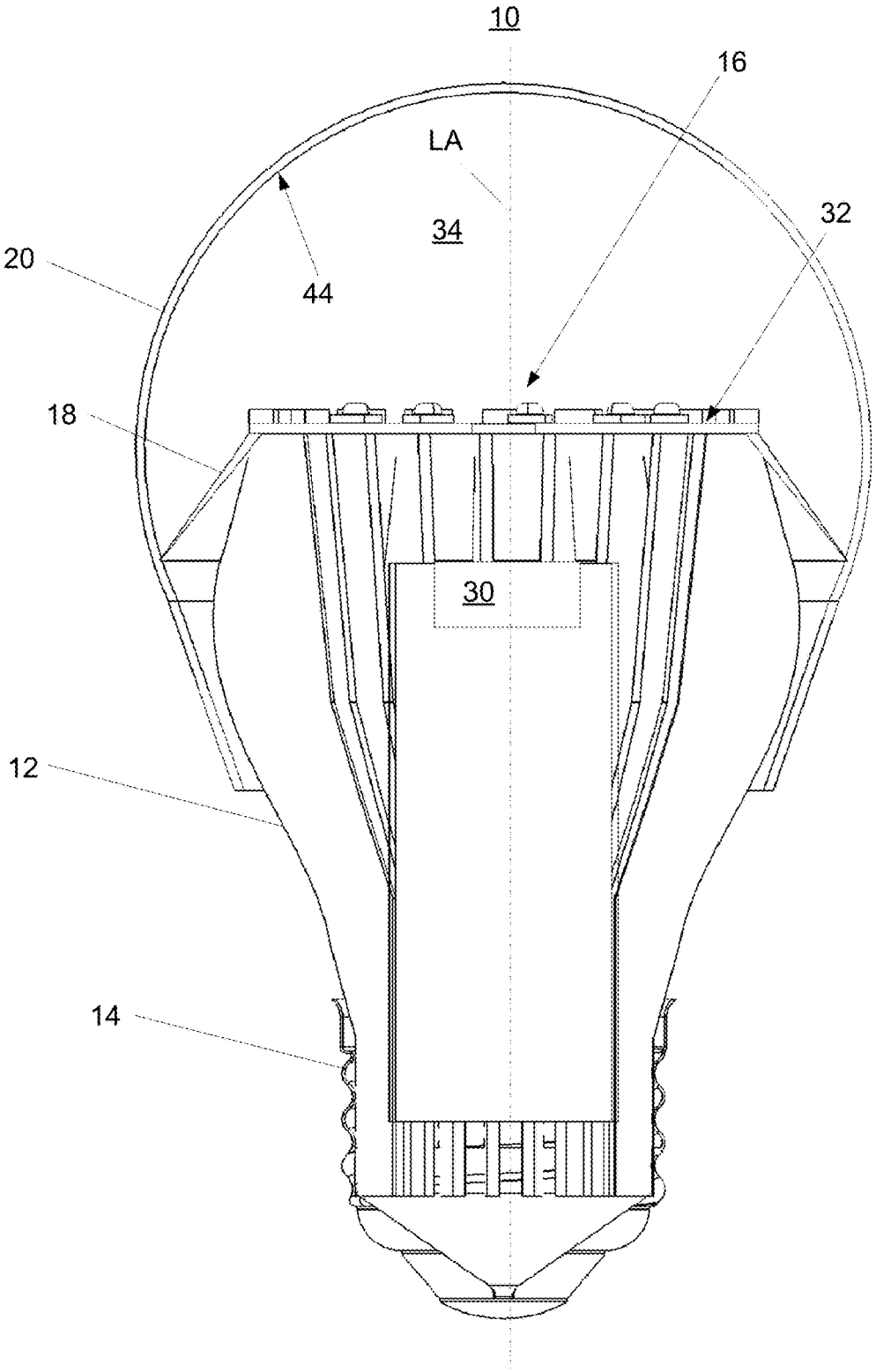
FIG. 6 illustrates a cross-sectional view of the omnidirectional LED retrofit lamp taken along lines XI-XI of FIG. 3.

The driver circuitry 30, FIG. 6, is configured to receive alternating current (AC) from the lighting fixture (e.g., via electrical connection(s) 24 of mounting base 14) and convert the AC to direct current (DC), e.g., using a rectifier or the like. The driver circuitry 30 may also be configured to supply specific voltages to the plurality of top-emitting LED packages 28. For example, the driver circuitry 30 may provide a first voltage to the first set 36 of the plurality of LED packages 28 and a second voltage to the second set 38 of the plurality of LED packages 28. Driver circuitry 30 may be integrated into the planar PC board 26 (e.g., on the top 32 and/or bottom surfaces thereof) and/or may be coupled (either directly or indirectly) to the housing 12 (e.g., the heat sink).

As noted above, the Energy Star compliant LED retrofit lamp 10 (FIGS. 3-6) also includes a reflector 18 and a light-transmissive cover 20. The reflector 18 may be directly or indirectly coupled, mounted, and/or otherwise secured to the housing 12, the light engine 16 (e.g., the PCB 26), and/or the light-transmissive cover 20. The reflector 18 is configured to receive light emitted from the first and/or second sets 36, 38 of top-emitting LED packages 28 of the light engine 16 and/or light reflected from an internal surface 44 of the light-transmissive cover 20 emitted by the light engine 16, and redirect (e.g., reflect) the light back towards the light-transmissive cover 20. According to one embodiment, reflector 18 is disposed below light engine 16 (e.g., reflector 18 is disposed closer to the mounting base 14 than the PCB 26 of the light engine 16 is to the mounting base 14). Reflector 18 may circumscribe the light engine 16 and/or the housing 12. For example, reflector 18 may have a generally frustoconical shape, may be a portion of an approximate conical shape, and/or may be a portion of an approximate toroidal shape.

The shape and contours of the reflector 18 may be designed to control and redirect the low angle light rays emitted by the second set 38 of top-emitting LED packages 28. The exact shape and contours of the reflector 18 will therefore depend on the intended application and may be selected such that the light emitted by the omnidirectional LED retrofit lamp 10 complies with the Energy Star standard. For example, the shape and contours of the reflector 18 will depend on the number, placement, and viewing angles of the plurality of top-emitting LED packages 28.

Figure 11:
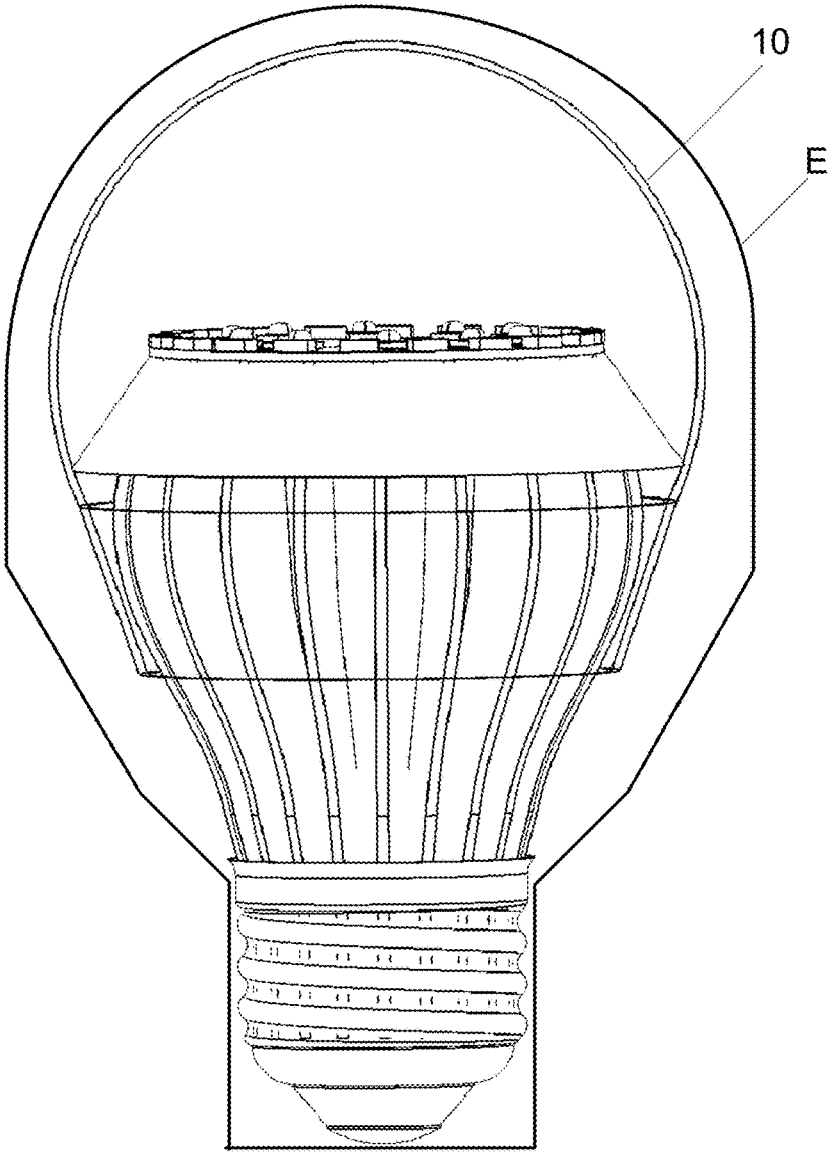
FIG. 11 generally illustrates one embodiment of an omnidirectional LED retrofit lamp consistent with the present disclosure within the spatial volume envelope for an ANSI type A-19 (A60) incandescent lamp, in accordance with embodiments of the present disclosure.

The light-transmissive cover 20 may be directly or indirectly coupled, mounted, and/or otherwise secured to the housing 12, the light engine 16 (e.g., the PCB 26), and/or the reflector 18. The light-transmissive cover 20 is configured to receive light emitted from the first and/or second sets 36, 38 of top-emitting LED packages 28 of the light engine 16 and/or light reflected from the reflector 18 and redirect some of the light towards the reflector 18 such that the light emitted from the light-transmissive cover 20 is compliant with an Energy Star standard. According to one embodiment, the light-transmissive cover 20 may extend above and/or below the light engine 16, i.e., to extend above and/or below PCB 26. The light-transmissive cover 20 may circumscribe the light engine 16 and/or the reflector 18, and may be disposed radially lateral of the reflector 18. The light-transmissive cover 20, housing 12, and mounting base 14 may be bounded by (e.g., fit within) a spatial envelope not exceeding a standard lamp shape (e.g., but not limited to, a standard A19 lamp shape, B type lamps, and/or other standard lamp form factors as shown in FIG. 11). The light-transmissive cover 20 may include a diffuse material (e.g., the light-transmissive cover 20 may be diffuse throughout its bulk material), a transparent material, and/or a semi-transparent material. According to one embodiment, the light-transmissive cover 20 is made from a plastics material sold under the trade designation Keiwa Opalus PBS 630H. One of ordinary skill appreciates the exact shape and contours of the light-transmissive cover 20 depend on the intended application. For example, the shape and contours of the light-transmissive cover 20 will depend on the number, placement, and viewing angles of the plurality of top-emitting LED packages 28, as well as the bounds of the spatial envelope of the lamp standard for which it is intended as a retrofit.

Figure 10:
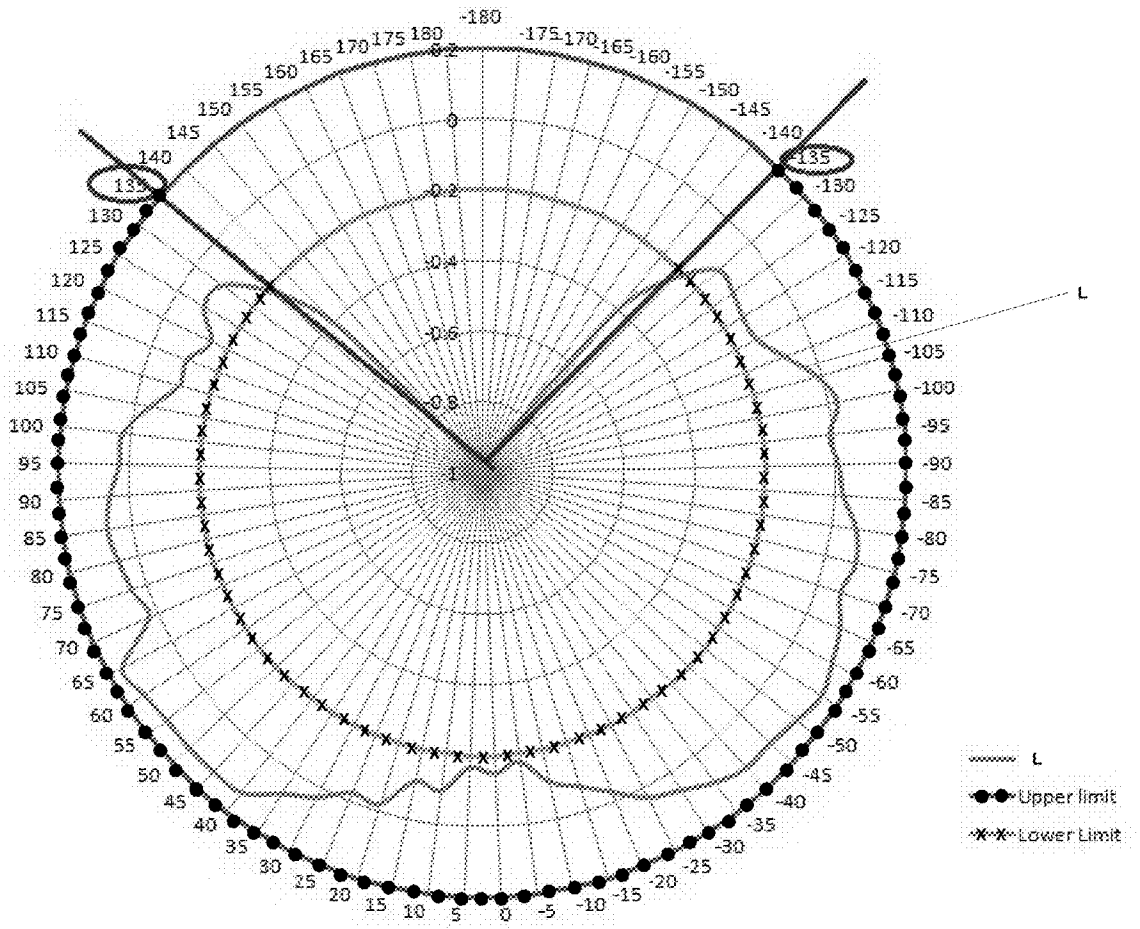
FIG. 10 generally illustrates the polar distribution of the light emitted by one embodiment of an omnidirectional LED retrofit lamp, in accordance with embodiments of the present disclosure.

Turning now to FIG. 10, a polar distribution of the light L emitted by one embodiment of an Energy Star compliant omnidirectional LED retrofit lamp 10 consistent with the present disclosure is generally illustrated. As can be seen, the light L emitted by the Energy Star compliant omnidirectional LED retrofit lamp 10 within the first range of transmission from −135 degrees to 135 degrees has a luminous intensity (including a peak intensity) that is within +/−20% of the average intensity within the range. In the exemplary embodiment, the Energy Star compliant omnidirectional LED retrofit lamp 10 has a minimum luminous flux of 990 lumens integrated value. Additionally, a region of light emitted from the Energy Star compliant omnidirectional LED retrofit lamp 10 in the second range of +135 degrees to 180 degrees has a minimum light intensity of at least 5% of the total flux. Additionally, as generally illustrated in FIG. 11, the Energy Star compliant omnidirectional LED retrofit lamp 10 fits within the spatial volume envelope E for an ANSI type A-19 (A60) incandescent lamp.

Another embodiment of an Energy Star compliant omnidirectional LED retrofit lamp 10 consistent with the present disclosure includes a first set 36 of 10 top-emitting LED packages 28, a second set 38 of 20 top-emitting LED packages 28, wherein each top-emitting LED package 28 is supplied 30 volts, the operating current to each top-emitting LED package 28 is 275 mA, the total lumens of the Energy Star compliant omnidirectional LED retrofit lamp 10 is 1037, the electrical efficiency of the Energy Star compliant omnidirectional LED retrofit lamp 10 is 0.8, the total power to the top-emitting LED packages 28 is 8.28 W, the Energy Star compliant omnidirectional LED retrofit lamp 10 wattage is 10.35 W, the LPW is 100, and the estimated aggregate cost of the top-emitting LED packages 28 is about US $3.00. Again, this embodiment of the Energy Star compliant omnidirectional LED retrofit lamp 10 is Energy Star compliant and fits within the spatial volume envelope E for an ANSI type A-19 (A60) incandescent lamp.

An Energy Star compliant omnidirectional LED retrofit lamp 10 consistent with one or more embodiments of the present disclosure may therefore provide omnidirectional light distribution that is both uniform and highly efficient within the range of −135 degrees to 135 degrees. The Energy Star compliant omnidirectional LED retrofit lamp 10 therefore satisfies the Energy Star standard. The Energy Star compliant omnidirectional LED retrofit lamp 10 features a plurality of top-emitting LED packages 28 that are all mounted onto a single, planar PCB 26. This combination eliminates the need for side-emitting batwing-optic type LED packages (which are more expensive and less efficient), and also results in significantly reduced and simpler optical components (e.g., the Energy Star compliant omnidirectional LED retrofit lamp 10 only uses a single reflector 18 and a light transmissive cover 20). An omnidirectional LED retrofit lamp 10 consistent with the present disclosure therefore uses less expensive and more efficient top-emitting LED packages 28, and has a reduced overall manufacturing costs compared to other omnidirectional LED lamps. Moreover, the Energy Star compliant omnidirectional LED retrofit lamp 10 may fit within a spatial envelope of a standard lamp (e.g., a standard A19 lamp shape).

According to one aspect, the present disclosure features a light emitting diode (LED) lamp. The LED lamp includes a housing, a mounting base, a light engine, a light-transmissive cover circumscribing the light engine, and a reflector. The mounting base is attached to the housing and is adapted to make mechanical and electrical connection with a socket. The light engine is coupled to the housing and comprises a planar PC board having an upper surface perpendicular to a longitudinal axis of the LED lamp. The light engine further includes a plurality of top-emitting LED packages mounted on the upper surface. The top-emitting LED packages are each configured to emit light having an angular distribution centered around a principal light-emitting direction that is normal to an emission face, and includes a first and a second set of top-emitting LED packages. The first set of top-emitting LED packages is mounted to the planar PC board such that its principal light-emitting direction is perpendicular to the planar PC board. The second set of top-emitting LED packages is mounted to the planar PC board such that its principal light-emitting direction is orthogonal to that of the first set of top-emitting LED packages and parallel to the PCB upper surface. The second set of top-emitting LED packages is located at a peripheral region of the light engine PCB (and optionally surrounds the first set of top-emitting LED packages). The reflector is disposed below the light engine and extends generally towards the mounting base reflects light towards the cover. The cover emits light received directly from the light engine and reflected light from the reflector. A polar light distribution of light emitted from the LED lamp in a first range of transmission from −135 degrees to +135 degrees has a minimum luminous flux of 990 lumens integrated value, and over the range, any luminous intensity (including a peak intensity) is within +/−20% of the average intensity within the range.

Preferably, the polar light distribution of light emitted from LED lamp 10, when energized, in a second range of +135 degrees to 180 degrees, has a minimum light intensity present that is at least 5% of the total flux of all the light emitted from LED lamp 10. More preferably, the light emitted from the LED lamp in a range of transmission from −135 degrees to +135 degrees has a minimum luminous flux of 1030 lumens integrated value.

Optionally, the first set of top-emitting LED packages emits about 25 lumens each, and the second set of top-emitting LED packages emits about 50 lumens each. The first set of top-emitting LED packages may be positioned within a central region of the PCB. For example, the second set of top-emitting LED packages is positioned on the PCB within a region bounded by a 40 mm diameter. The second set of top-emitting LED packages may be disposed on a virtual circle.

The first set of top-emitting LED packages may include ten (10) top-emitting LED packages and the second set of top-emitting LED packages may include twenty (20) top-emitting LED packages. For example, the first set of top-emitting LED packages may comprise not more than ten (10) top-emitting LED packages and the second set of top-emitting LED packages may comprise not more than twenty-five (25) top-emitting LED packages. Alternatively (or in addition), the first set of top-emitting LED packages may comprise not more than ten (10) top-emitting LED packages and the second set of top-emitting LED packages may comprise not more than twenty (20) top-emitting LED packages.

The first and the second sets of top-emitting LED packages are devoid of a batwing optic, and may be devoid of any optic. The reflector and/or cover are coupled to the housing. The LED lamp may be bounded by a spatial envelope not exceeding a standard A19 lamp shape. The reflector may be a portion of an approximate conical shape and/or a portion of an approximate toroidal shape. The lamp cover may be diffuse.

In optional embodiments, the first and second sets 36, 38 of top-emitting LED packages may have a viewing angle not exceeding 90 degrees. For example, the viewing angle may not exceed 80 degrees and/or may not exceed 60 degrees.

While the principles of the invention have been described herein, it is to be understood by those skilled in the art that this description is made only by way of example and not as a limitation as to the scope of the invention. Reference numerals corresponding to the embodiments described herein may be provided in the following claims as a means of convenient reference to the examples of the claimed subject matter shown in the drawings. It is to be understood however, that the reference numerals are not intended to limit the scope of the claims. Other embodiments are contemplated within the scope of the present invention in addition to the exemplary embodiments shown and described herein. Modifications and substitutions by one of ordinary skill in the art are considered to be within the scope of the present invention, which is not to be limited except by the recitations of the following claims.

Following is a non-limiting list of reference numerals used in the drawings of the present disclosure:

10 Energy Star compliant omnidirectional LED retrofit lamp
12 Housing
14 Mounting base
13 Plurality of fins
16 Light engine
18 Reflector
20 Light-transmissive cover
22 Threads
24 Electrical connections
26 Printed circuit board (PCB)
28 Top-emitting LED packages
30 Driver circuitry
32 Upper surface
34 Cavity
36 First set of top-emitting LED packages
38 Second set of top-emitting LED packages
39 LED
40 Central region
41 Frame/mount
42 Perimeter/periphery
43 Electrical contacts/electrodes
44 Internal surface
45 Emission face/surface
47 Side-emitting LED package
51 LED
53 Frame
55 Electrical contacts/electrodes
57 Optic
59 Emission face/surface
LA Longitudinal axis
Principal light emitting direction
E Spatial envelope
L Light
P1 Principal light emitting direction
P2 Principal light emitting direction

What is claimed is:

1. A light emitting diode (LED) lamp comprising:

a housing;

a mounting base attached to said housing adapted to make mechanical and electrical connection with a socket;

a light engine coupled to said housing and comprising a printed circuit board (PCB) having a planar upper surface tangent to a single plane and perpendicular to a longitudinal axis (LA) of said LED lamp, said light engine further comprising a plurality of top-emitting LED packages mounted on said upper surface, said top-emitting LED packages each configured to emit light having an angular distribution centered around a principal light-emitting direction that is normal to an emission face of each said LED package, said plurality top-emitting LED packages comprising a first set of top-emitting LED packages and a second set of top-emitting LED packages;

wherein said first set of top-emitting LED packages is mounted to said PC board such that a principal light-emitting direction (P1) of each LED package of the first set is perpendicular to said planar upper surface of said PC board, said first set of top-emitting LED packages being located within a peripheral region of the light engine PCB; and wherein said second set of top-emitting LED packages is mounted to said PC board such that a principal light-emitting direction (P2) of each LED package of the second set is orthogonal to said principal light-emitting direction (P1) of said first set of top-emitting LED packages and parallel to said planar upper surface, said second set of top-emitting LED packages being located at the peripheral region of said light engine PCB;

a light-transmissive cover circumscribing said light engine;

a reflector disposed below said light engine and extending generally towards said mounting base, said reflector arranged to reflect light towards said cover, and wherein said cover is arranged to emit light received directly from said light engine and reflected light from said reflector;

wherein a polar light distribution of light emitted from said LED lamp, when energized, in a first range of transmission from −135 degrees to +135 degrees has a minimum luminous flux of 990 lumens integrated value and wherein over said range any luminous intensity, including a peak intensity, is within +/−20% of the average intensity within said range.

2. The LED lamp of claim 1, wherein each said LED package of the first set of top-emitting LED packages emits about 25 lumens, and each said LED package of the second set of top-emitting LED packages emits about 50 lumens.

3. The LED lamp of claim 1, wherein said first set of top-emitting LED packages is positioned within a central region of said PCB.

4. The LED lamp of claim 3, wherein said second set of top-emitting LED packages is positioned on said PCB within a region bounded by a 40 mm diameter.

5. The LED lamp of claim 1, wherein said second set of top-emitting LED packages is disposed on a virtual circle.

6. The LED lamp of claim 5, wherein said first set of top-emitting LED packages comprises not more than 10 top-emitting LED packages and said second set of top-emitting LED packages comprises not more than 25 top-emitting LED packages.

7. The LED lamp of claim 5, wherein said first set of top-emitting LED packages comprises not more than 10 top-emitting LED packages and said second set of top-emitting LED packages comprises not more than 20 top-emitting LED packages.

8. The LED lamp of claim 1, wherein said first set of top-emitting LED packages comprises 10 top-emitting LED packages and said second set of top-emitting LED packages comprises 20 top-emitting LED packages.

9. The LED lamp of claim 1, wherein said second set of top-emitting LED packages is mounted to said PC board in an orientation perpendicular to said first set of top-emitting LED packages.

10. The LED lamp of claim 1, wherein the LED packages of said second set of top-emitting LED packages are devoid of an optic.

11. The LED lamp of claim 1, wherein said reflector is coupled to said housing.

12. The LED lamp of claim 1, wherein said LED lamp is bounded within a spatial envelope defined by an ANSI A19 lamp shape.

13. The LED lamp of claim 1, wherein the reflector is a portion of an approximate conical shape.

14. The LED lamp of claim 1, wherein the reflector is a portion of an approximate toroidal shape.

15. The LED lamp of claim 1, wherein the polar light distribution of light emitted from said LED lamp, when energized, in a second range of +135 degrees to 180 degrees, has a minimum light intensity present that is at least 5% of the total flux.

16. The LED lamp of claim 1 wherein the lamp cover is diffuse.

17. The LED lamp of claim 1, wherein light emitted from said LED lamp, when energized, in a range of transmission from −135 degrees to +135 degrees has a minimum luminous flux of 1030 lumens integrated value.

18. The LED lamp of claim 1, wherein said first set of top-emitting LED packages and said second set of top-emitting LED packages have a viewing angle not exceeding 90 degrees.

19. The LED lamp of claim 18, wherein said viewing angle does not exceed 80 degrees.

20. The LED lamp of claim 18, wherein said viewing angle does not exceed 60 degrees.

* * * * *